United States Patent [19]

Wyche

[11] Patent Number: 5,060,757

[45] Date of Patent: Oct. 29, 1991

[54] ADJUSTABLE RUNGS FOR LADDER

[75] Inventor: C. Thomas Wyche, Greenville, S.C.

[73] Assignee: Naturaland Trust, Greenville, S.C.

[21] Appl. No.: 551,138

[22] Filed: Jul. 11, 1990

[51] Int. Cl.[5] ..... E06C 7/08

[52] U.S. Cl. ..... 182/228; 182/194

[58] Field of Search ..... 182/228, 220, 194

[56] References Cited

U.S. PATENT DOCUMENTS

| | | | |
|---|---|---|---|
| 1,116,073 | 11/1914 | Johnson et al. | 182/228 |
| 1,823,509 | 9/1931 | Peters | 182/228 |
| 1,960,863 | 5/1934 | Boyer | 182/228 |
| 2,599,976 | 6/1952 | Carlson | 182/228 |
| 2,941,617 | 6/1960 | Stiffler . | |
| 3,282,378 | 9/1964 | Pierce . | |
| 3,380,697 | 4/1968 | Melcher . | |
| 3,985,204 | 10/1976 | Lattig . | |
| 4,289,215 | 9/1981 | Robinson . | |
| 4,605,097 | 8/1986 | Maxwell . | |

FOREIGN PATENT DOCUMENTS

| | | | |
|---|---|---|---|
| 2707547 | 1/1979 | Fed. Rep. of Germany | 182/228 |
| 1211973 | 10/1959 | France | 182/228 |

*Primary Examiner*—Reinaldo P. Machado

*Attorney, Agent, or Firm*—Dority & Manning

[57] ABSTRACT

Adjustable cross pieces or rungs for aiding in forming a ladder using a tree cut at predetermined lengths and trimmed of branches. The cross members include two end members and a centrally located channel member which receives an elongated main body portion of the end members and which can be stabilized at the top and bottom rungs for securing the trees together and forming foot rests or rungs for the ladder.

3 Claims, 2 Drawing Sheets

ADJUSTABLE RUNGS FOR LADDER

BACKGROUND OF THE INVENTION

In developing trails through remote mountainous areas, it is often necessary to go over and down obstructions such as rock formations, rivers and the like. It is desireable that these trails be accessible to the general public in order for full enjoyment of the wilderness. The problem in building ladders and the like is that these obstructions may be several miles from access roads and as a result, they have to be carried on one's back. When there are several ladders necessary along the trail, such is not practical.

SUMMARY OF THE INVENTION

The invention constructed in accordance with the present invention pertains to adjustable cross pieces or rungs for a ladder to be assembled using trees and the like in remote locations. The trees are cut and trimmed to a length corresponding to the desired height of the ladder. The cross pieces serve as the rungs for the ladder. Each of the cross pieces includes a pair of end members that have a substantially rectangular cross section that includes an elongated main body portion which terminates in a flange portion perpendicular to the elongated portion. In the top cross pieces and bottom cross pieces, holes are provided in the flange portion through which fastening members such as screws or nails pass for securing the respective flange portions to the trees. A centrally located channel member is provided for receiving the elongated main body portions of the end members in a telescoping fashion. In the top cross pieces and bottom cross pieces, holes are provided in both the channel member and the elongated main body portion of the end members so that bolts or the like can be inserted therethrough for securing the end members within the channel shaped member. Upon fastening all of the cross pieces, the top cross piece and bottom cross piece are stabilized by lining up a hole at the end of each channel member with a hole of the flange portion and inserting the bolt or like through the holes. There is no need for stabilizing the interior rungs of the ladder because with the top and bottom rungs stabilized, the interior rungs cannot separate or move. Greater stability may be achieved by drilling holes in the interior rungs and inserting bolts or the like after the top and bottom rungs have been stabilized. The cross pieces are spaced along the length of the two parallel trees to produce a ladder which can be used for scaling obstructions and the like.

BRIEF DESCRIPTION OF THE DRAWINGS

The apparatus constructed in accordance with the present invention will be better understood by considering the following detailed description taken along with the following drawing in which the numerals indicate like parts.

In the drawings.

DETAILED DESCRIPTION OF THE DRAWINGS

Figure 1:
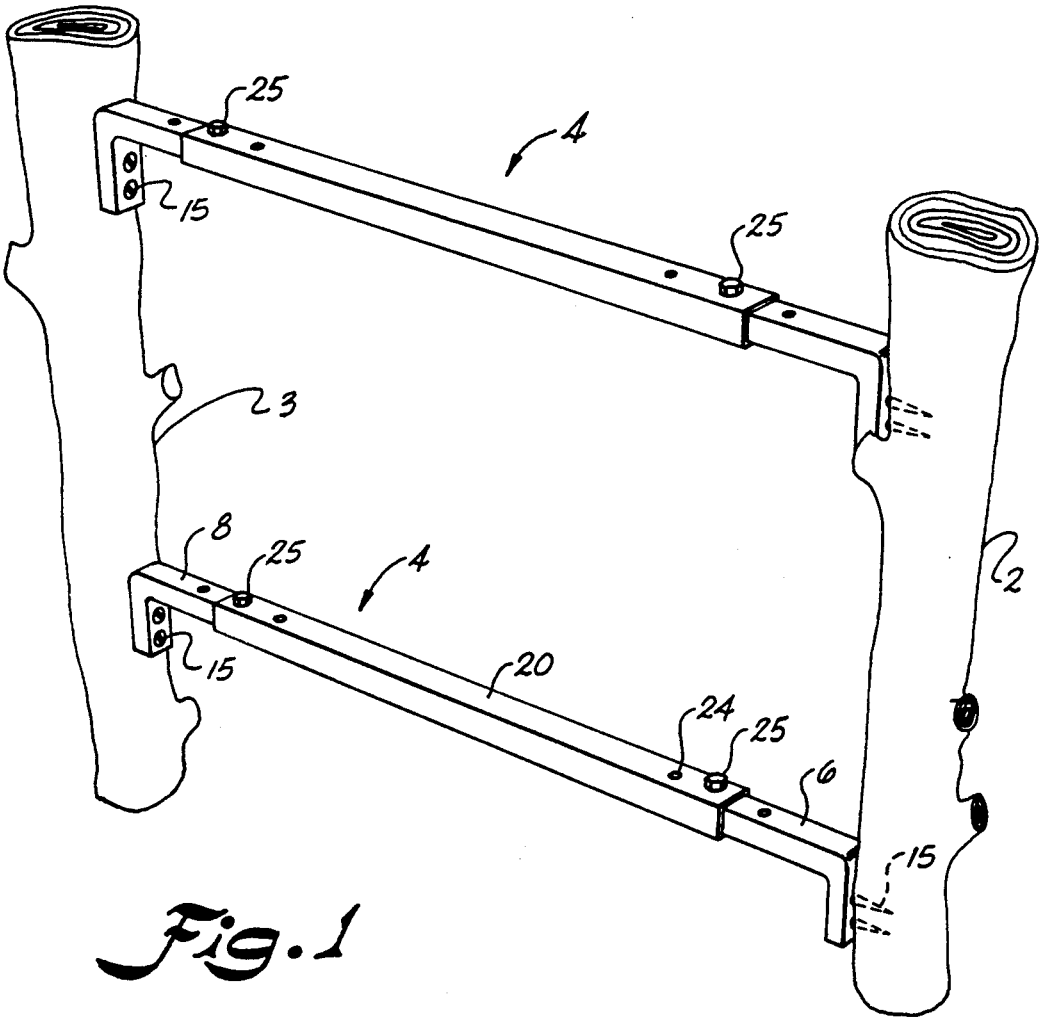
FIG. 1 is a perspective view illustrating a ladder constructed from trees and cross pieces.
Figure 2:
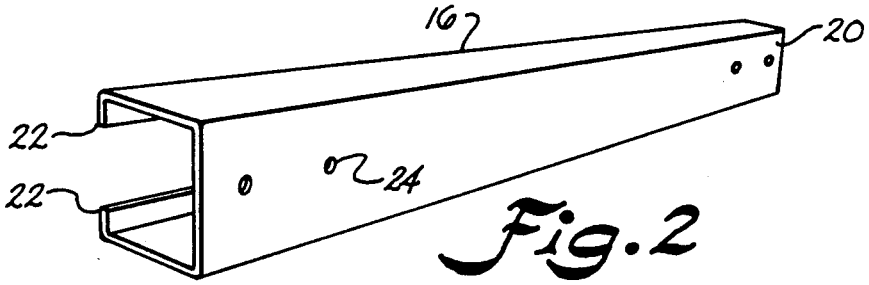
FIG. 2 is a perspective view illustrating a channel member forming part of the cross piece.
Figure 3:
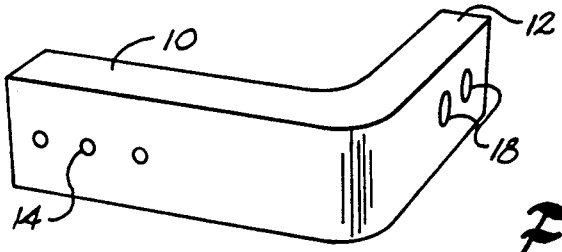
FIG. 3 is a perspective view illustrating one of the end members forming part of the cross pieces.
Figure 4:
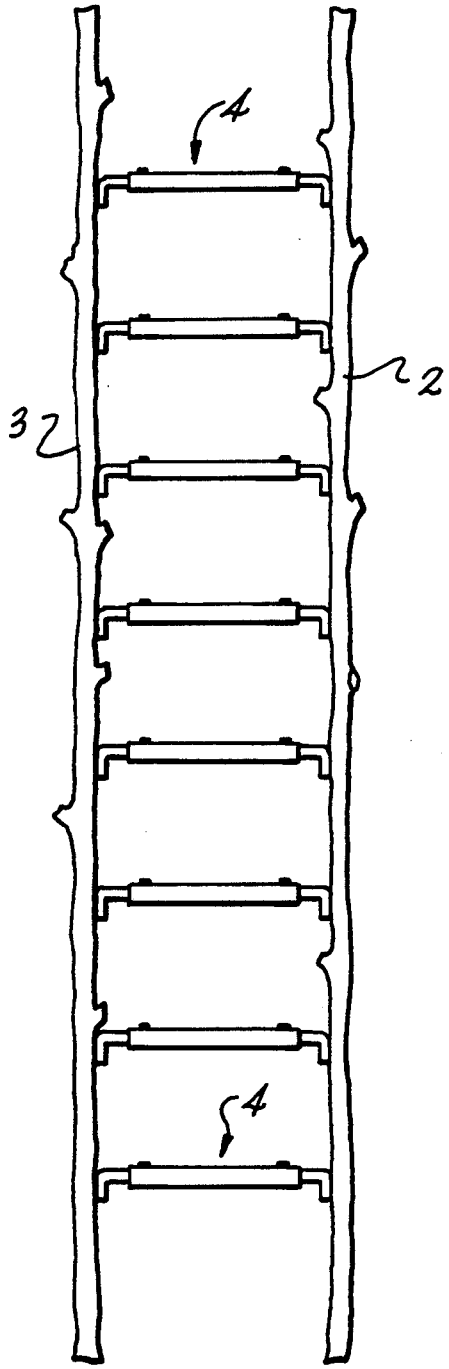
FIG. 4 is a perspective view of a long ladder constructed in accordance with the present invention.

Referring to FIG. 1 of the drawings, there is illustrated a ladder constructed utilizing the cross pieces forming part of the invention. The ladder is constructed from a pair of trees 2 and 3 that are normally cut at the site where it is desired to use the ladder. The trees may be cut to any desired length and trimmed of its branches. Cross pieces 4 are secured along the length of the spaced trees 2 and 3 to provide foot rests for the ladder.

Each of the cross pieces includes a pair of end members 6 and 8. Each of the end members includes an elongated main body portion 10 which terminates in a right angle flange 12. Holes 14 are provided in the elongated main body portion 10 through which a fastening means such as bolts or the like at 24 can be inserted when securing the end member to a channel member 16. Holes 18 are also provided in the flange portion 12 through which screws or the like be extended for attaching the end member to the trees 2.

The end members in one particular embodiment are constructed of lightweight aluminum bar stock and have a cross section of approximately $\frac{7}{8}$ inch by $\frac{1}{2}$ inch.

The channel member 16 includes an elongated "C" channel 20 which has inwardly turned protrusion 22 provided on the free edges of the channel 20. The purpose of the protrusions 22 is to define along with the "C" channel a rectangular or tubular receiver into which the elongated main body portion of the end members can be inserted in a telescoping manner.

Once the elongated members are inserted in the channel member, holes 24 provided in the top and bottom channel member are aligned with the holes 14 provided in the top and bottom end member so that a bolt 25 or the like can be inserted therethrough for fixing the length of the cross member. The only way that the end members can be removed from the channel member is by sliding such longitudinal. The width of the ladder can be varied by adjusting the alignment of the holes 14 and 24 of the "C" shaped channel member and elongated main body portion of the top and bottom rungs.

It is not necessary that the channel members be secured by bolts to the end members for the foot rest positioned intermediate the top and bottom rungs. However, to produce a more stable ladder, the channel member may be fixed to the end members along the full length of the ladder by drilling holes after the top and bottom rungs have been stabilized and then inserting in such holes a bolt or the like.

When installing the rungs 4 between the spaced trees 2 and 3, the flange portion faces downward as shown in FIG. 1 with the end surface being held flush against the side of the tree by screws 15 or the like.

It will be understood, of course, that while the form of the invention herein shown and described constitutes a preferred embodiment of the invention, it is not intended to illustrate all possible forms of the invention. It will also be understood that the words used are words of description rather than of limitations and that various changes may be made without departing from the spirit and scope of the invention herein disclosed.

What is claimed is:

1. Adjustable cross pieces of rungs for a ladder to be assembled using trees and the like in remote locations, said trees being trimmed of branches and cut to a length corresponding to the desired eight of said ladder and being positioned parallel to each other, said cross pieces comprising:

a pair of "L" shaped end members, said end member having an elongated main body portion terminating in a flange portion, holes provided in said flange portion through which fastening members pass for securing a respective flange portion to a respective tree, a centrally located channel member receiving said elongated main body portions of said pair of end members, said elongated main body portions of said end members telescoping into said channel member;

a plurality of spaced holes provided in said main body portions of said "L" shaped end members, a plurality of spaced holes provided adjacent opposed ends of said channel member; and fastening means for being inserted through selected holes in said "L" shaped members and holes provided in said channel member for securing said end members to said channel member for selectively fixing the distance between said trees and producing a foot rest for said ladder.

2. The cross piece as set forth in claim 1 further comprising:

said channel member being an elongated "C" channel having a pair of opposed protrusions carried on free edges of the "C" channel so as to produce a substantially rectangular cross section, said "C" shaped channel along with said opposed protrusions only permitting said elongated main body portion of said end members to be inserted and removed from said channel member by longitudinally sliding said elongated main body portion into and out of said channel member.

3. The cross pieces as set forth in claim 1 wherein said flange portions extend downwardly along the inner surface of said trees when secured by said fastening members secure them to said trees.

* * * * *